United States Patent [19]

Rayment

[11] Patent Number: 4,656,904

[45] Date of Patent: Apr. 14, 1987

[54] FOOD PRODUCT CUTTER APPARATUS

[75] Inventor: Arthur G. Rayment, Santa Clara, Calif.

[73] Assignee: Lamb-Weston, Inc., Portland, Oreg.

[21] Appl. No.: 772,603

[22] Filed: Sep. 4, 1985

[51] Int. Cl.[4] ..... B26D 5/38

[52] U.S. Cl. ..... 83/289; 83/284; 83/371; 83/542; 83/582; 83/588; 83/698

[58] Field of Search ..... 83/289, 284, 321, 371, 83/542, 588, 639, 698, 582, 583, 543

[56] References Cited

U.S. PATENT DOCUMENTS

| | | | |
|---|---|---|---|
| 3,811,348 | 5/1974 | Brown | 83/588 X |
| 3,886,826 | 6/1975 | Brown | 83/639 X |
| 4,114,488 | 9/1978 | Vornfett | 83/198 |
| 4,576,071 | 3/1986 | Rayment | 83/371 X |

*Primary Examiner*—James M. Meister

*Attorney, Agent, or Firm*—Klarquist, Sparkman, Campbell, Leigh & Whinston

[57] ABSTRACT

A cutter apparatus is disclosed for cutting elongated food products such as french fry potato strips, to cut them in two or to remove defects. The cutter apparatus includes two independently operated knives which are actuated by pneumatic cylinders controlled by solenoid valves that apply air pulses to such cylinders for fast operation. The valves are operated in response to control signals produced by light sensor means which senses the defect and causes a central processing unit of a computer to produce the control signals. The knife blades are each connected to the piston rod of the cylinder by a flexible resilient connector for causing the blade to move in a non-linear manner downward in response to linear movement of the piston rod for cutting the defect from the food product while such product is moving along a conveyor belt beneath such cutter, without arresting movement of the food product. The knife blade is returned to a raised static position by a rubber band strap member secured to the lower end of the piston rod. Two independently controlled knives are employed to enable the cutter to remove defects of different lengths with little waste or to cut product to different lengths.

20 Claims, 11 Drawing Figures

FOOD PRODUCT CUTTER APPARATUS

BACKGROUND OF THE INVENTION

The present invention relates to an improved cutter apparatus for cutting elongated food products and in particular to such a cutter apparatus which is capable of removing defects of different lengths while the food product is moving on a conveyor.

The cutter apparatus of the present invention is an improvement over that disclosed in pending U.S patent application Ser.No. 520,244, now U.S.- Pat. No. 4,576,071, filed Aug. 4, 1983 by Arthur G. Rayment and assigned to the assignee of the present application. The cutter apparatus of such prior application employs a single knife blade which is pivoted like a pendulum and cuts the food product in both swings to make the two cuts necessary for removal of a defect. In order to accomplish this, the knife blade has two cutting edges on opposite sides of the blade and is rotated through a small angle between cuts in order to enable the cuts to be made for removal of the defect without stopping movement of the food product on the conveyor. This prior cutting apparatus is too complicated and has not proved to be entirely successful.

It is very important not to stop or otherwise disturb the position of the french fry potato strip or other elongated food product on the conveyor belt during cutting, because if the food product is moved during the first cut then the second cut will be out of position with respect to the defect which is sought to be removed from the food product. Thus, it is important that the knife blade when cutting travel at approximately the same horizontal speed as the conveyor belt, so that such blade may cut the french fry strip or other food product without disturbing the position of the food product on the belt. The cutter apparatus of the present application is an improvement on the above-described earlier cutter apparatus, among other reasons because the angle of the knife blade is not adjusted between cuts and the blade is not swung like a pendulum to enable the knife blade to cut in both directions. Instead, in the present cutter apparatus two different knives are moved downward toward the conveyor belt at different times to make the two cuts necessary for removal of a defect. Also the knife blades are each operated by a cylinder which is controlled by a solenoid actuated valve to provide an extremely fast, reliable operation.

The present cutter apparatus is also an improvement over that shown in U.S. Pat. No. 4,114,488 issued Sept. 19, 1978 to Vornfett. This patent discloses a cutter apparatus in which the knife blades forming the two cuts necessary for removing the defect from the food product are fixed in position relative to each other. The two knife blades are moved simultaneously downward into contact with the food product as it is held in a trough, for removal of the defect. This has the disadvantage that defects of different lengths cannot be removed without also removing good food product. Therefore, the cutter apparatus of the present invention is faster, more versatile and more efficient and produces less waste than that of Vornfett.

SUMMARY OF INVENTION

It is therefore one object of the present invention to provide an improved cutter apparatus for cutting elongated food products to cut them into or to remove defects.

Another object of the invention is to provide such an improved cutter apparatus which is versatile and efficient so that it can remove defects of different length from elongated food products with less product waste.

A further object of the invention is to provide such a cutter apparatus which is fast, reliable and simple in operation.

An additional object of the invention is to provide such a cutter apparatus which employs two knives for making the two cuts at the opposite ends of the defect by independently operating such knife blades so that the cutter apparatus is capable of accurate removal of defects of different length.

Still another object of the present invention is to provide such a cutter apparatus in which the knife blade is connected to the actuator member by a resilient connector member of elastomer material which acts like a spring to cause the angle of the knife blade to change during downward movement of such blade, thereby enabling cutting of the food product to remove the defect without stopping movement of the food product as it is carried on a conveyor past the cutter apparatus.

A still further object of the cutter apparatus of the present invention is to provide an improved operating mechanism for movement of the knife blade by connection to the piston of a pneumatic cylinder controlled by an electrically actuated valve which is operated by a control signal produced in response to a light sensor means which detects the defect in the food product.

DESCRIPTION OF DRAWINGS

Other objects and advantages of the present invention will be apparent from the following detailed description of a preferred embodiment thereof, and from the attached drawings of which.

DESCRIPTION OF PREFERRED EMBODIMENT

Figure 1:
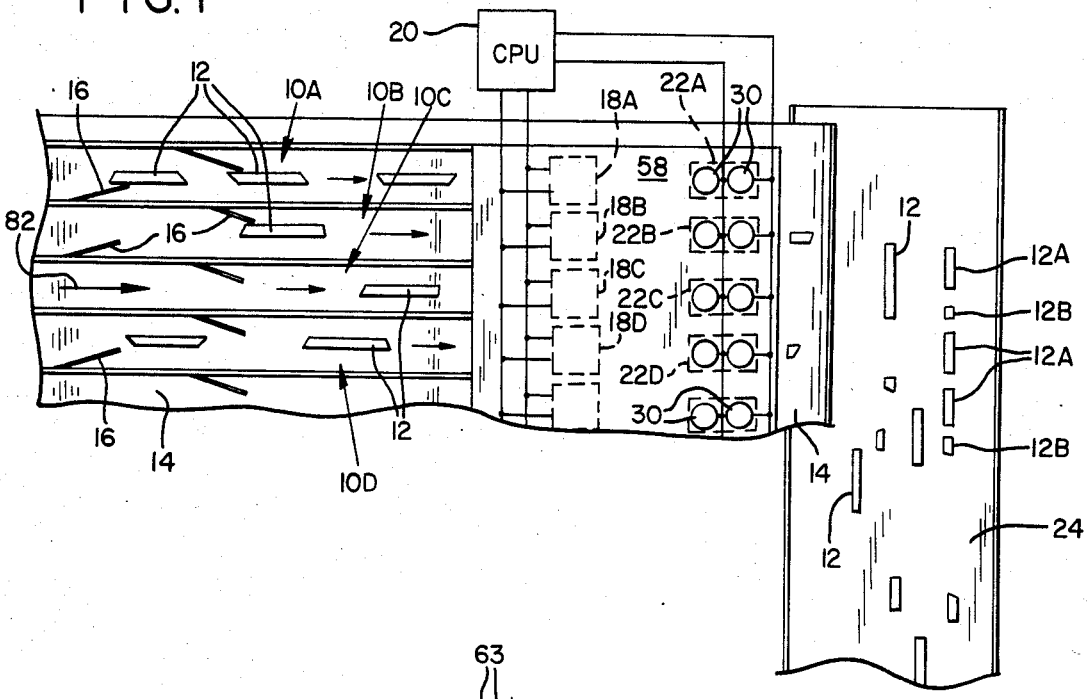
FIG. 1 is a plan view of a portion of a food product sensor and defect removal system employing the cutter apparatus of the present invention.

As shown in FIG. 1 the food product sensor and defect cutting system of the present invention includes a plurality of separate parallel channels 10A, 10B, 10C, 10D, etc., through which elongated food products 12, such as french fried potato strips, are conveyed on the top of an input conveyor belt 14. The potato strips 12 are aligned with their longitudinal axis substantially parallel to the walls of the channels and the direction of travel by deflector elements 16 which extend partially across the channel from the walls of such channel in the manner shown in pending U.S. patent application Ser. No. 520,244, now U.S. Pat. No. 4,576,071. Each of the channels 10A, 10B, 10C and 10D passes beneath a different one of a plurality of light sensor apparatus 18A, 18B, 18C and 18D. Each light sensor apparatus contains a plurality of light sources and detectors which simultaneously sense the elongated food product from several different sides to detect any defect in such food product which causes a change in color of the product, in the manner shown in pending U.S. patent application Ser. No. 520,244. However, it may be more desirable to provide additional light sources (up to 8 total) than is shown in the sensors of such pending patent application.

Figure 2:
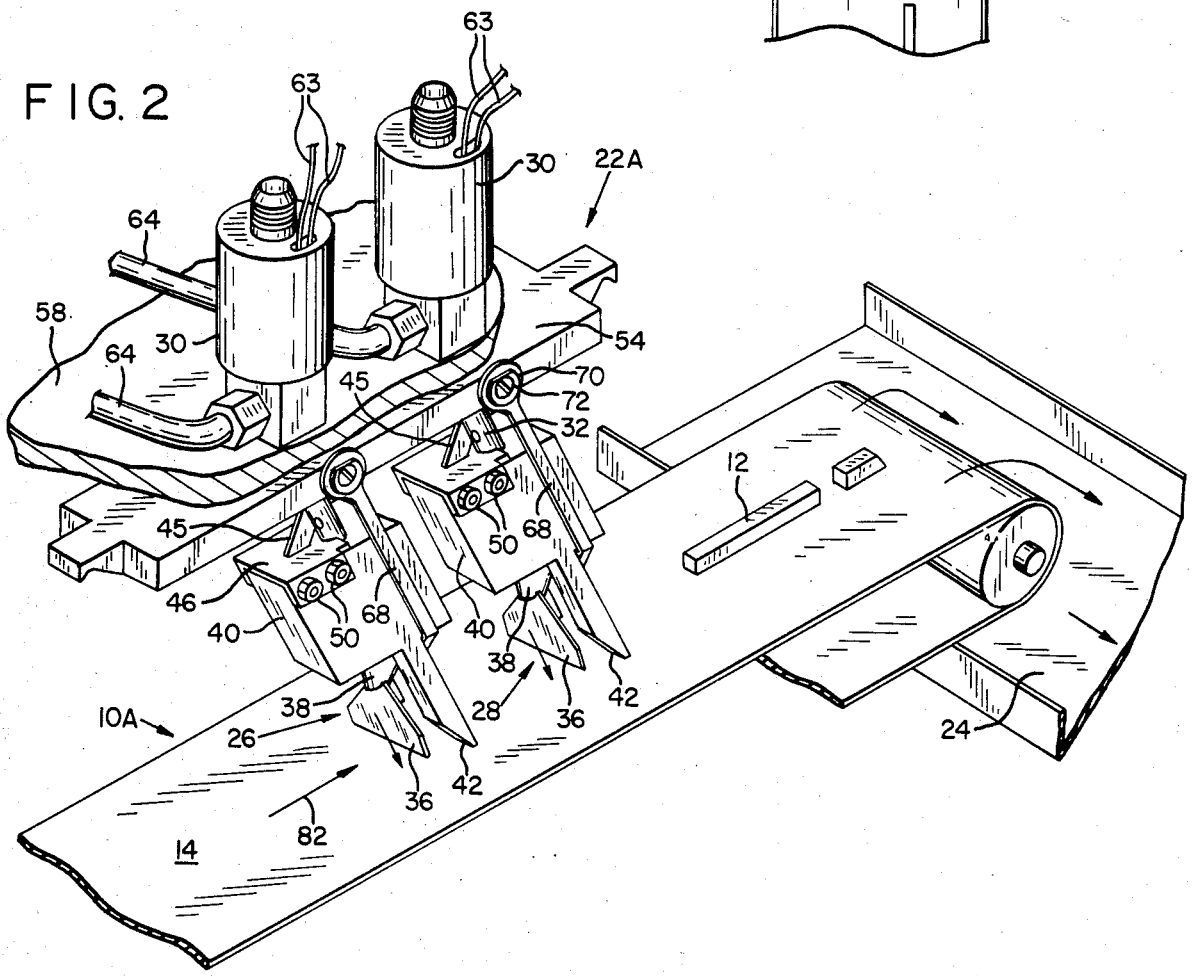
FIG. 2 is an enlarged oblique view of the cutter apparatus employed in the system of FIG. 1.
Figure 3:
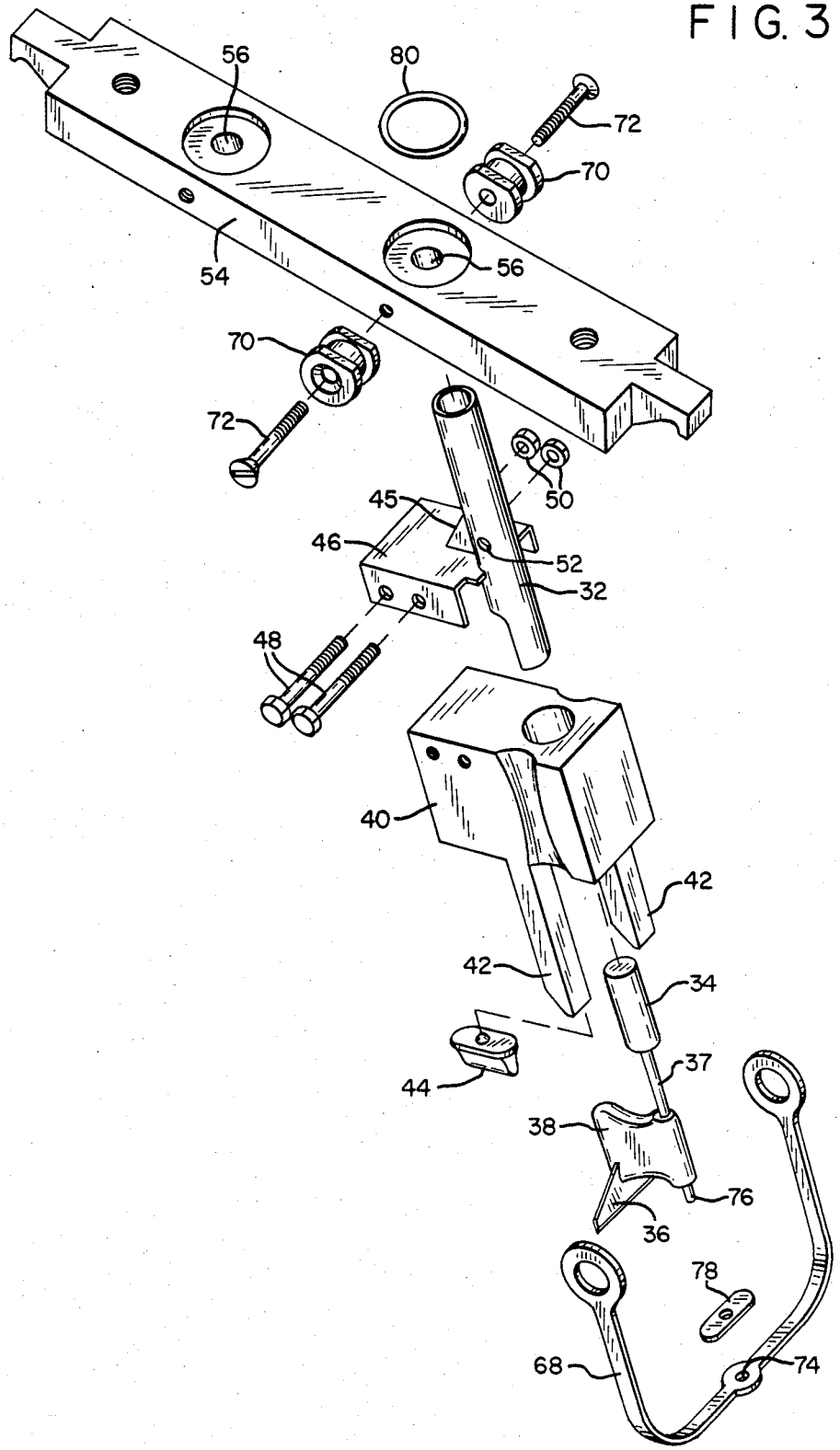
FIG. 3 is an exploded view on an enlarged scale of one of the cutter assemblies employed in the cutter apparatus of FIG. 2.
Figure 5:
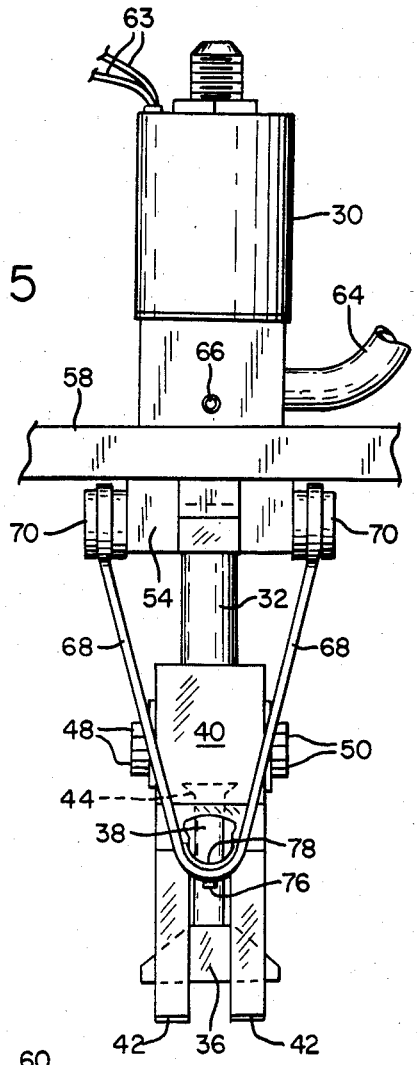
FIG. 5 is an end view looking from the left end of the apparatus of FIG. 4.
Figure 4:
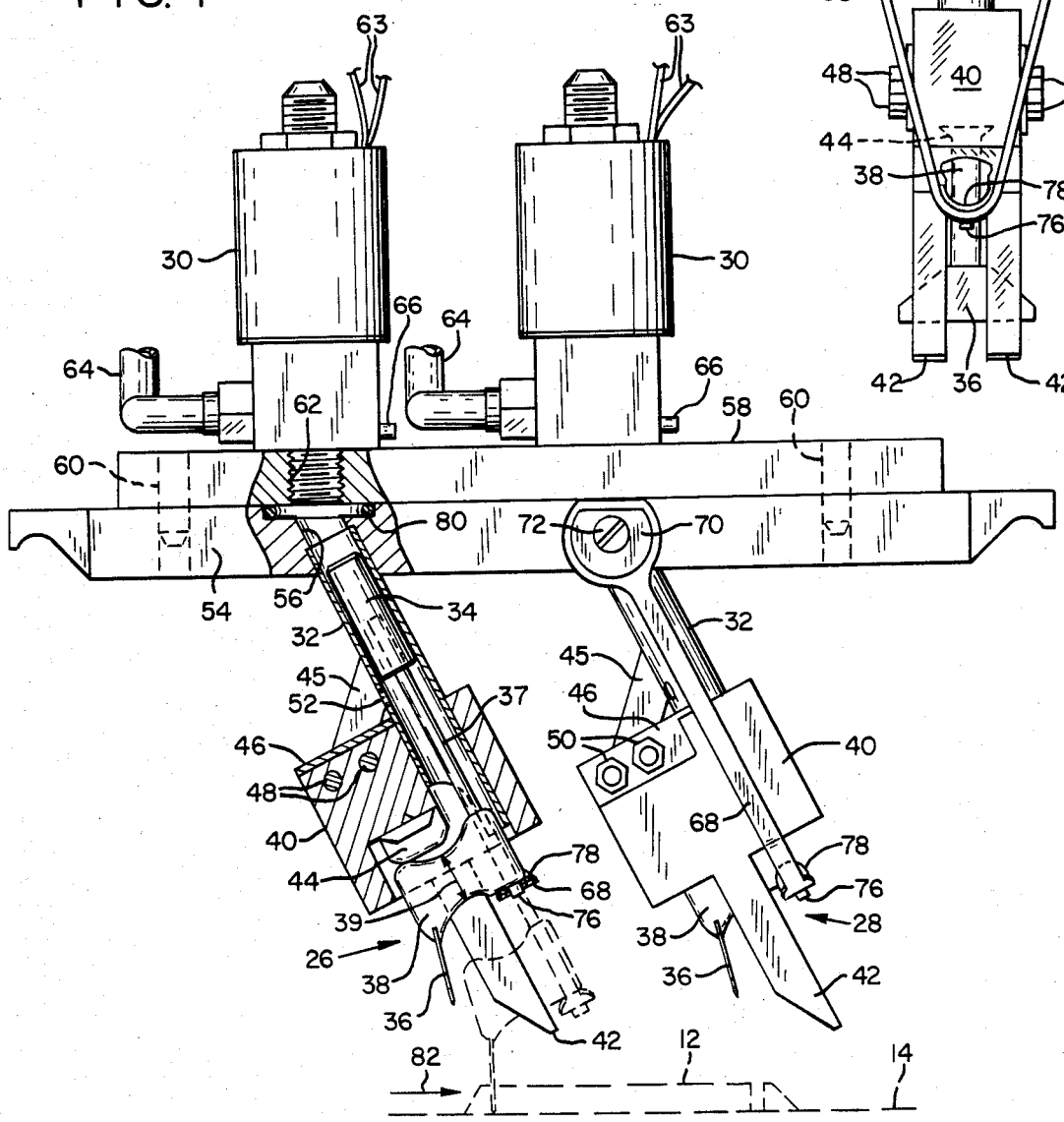
FIG. 4 is a side view of the cutter apparatus of FIG. 2 with parts broken away to show the internal construction of one cutter assembly.

The light sensors 18A, 18B, 18C and 18D produce detector output signals which are transmitted to the central processing unit (C.P.U.) 20 of a digital computer which converts such signals into cutter control signals. The control signals are transmitted from the CPU 20 to plurality of different cutter apparatus 22A, 22B, 22C and 22D which are aligned with channels 10A, 10B, 10C and 10D, respectively. The control signal actuates such cutter apparatus to operate two knife blades in each cutter apparatus for cutting the elongated food product to remove the defect therein when such defect exists, in the manner hereafter described. The elongated food products 12 including cut food products 12A and removed defects 12B are discharged from the input conveyor belt 14 onto an output conveyor 24. The defect portions 12B of the elongated food product are separated from the remaining food product by passing them through narrow slots in the output conveyor or by any other suitable separation means As shown in FIG. 2, each of the cutter apparatus 22A, 22B, 22C and 22D consists of two cutter assemblies 26 and 28 which are of the same identical construction so that only one will be described. The first knife assembly 26 is actuated to make one cut while the second knife assembly 28 is energized to make the second cut on opposite sides of the defect for removal of the defect even when it is in the middle of the french fry potato strip or other elongated food product. Each of the cutter assemblies is controlled by a solenoid actuated valve 30 which causes a pulse of air to be supplied to a pneumatic cylinder 32 of stainless steel within the cutter assembly for moving a piston 34 within the cylinder downward along with a knife blade 36 of stainless steel. The knife blade is connected to the piston rod 37 by a flexible resilient connector 38 having a central portion 39 of less width than its opposite ends so that such knife blade pivots about such central portion during linear movement of such piston rod, as shown in FIGS. 3 and 4. The piston 34 is preferably a cylindrical member made of a plastic material filled with wear resistant particles such as $AL_2O_3$ ceramic, including filled Nylon or the filled Teflon sold under the name "Rulon LD" by Dixon Industries Corporation of Bristol, Rhode Island, U.S.A. A plastic guide 40 which may be made of Teflon T.F.E. (tetrafluorethylene) having two guide finger projections 42 is provided to control downward movement of the flexible connector 38 and the knife blade 36 and to prevent rotation of the piston 34. The flexible connector 38 is made of a resilient elastomer material such as neoprene W.D. rubber and slides between the two guide fingers 42.

A cushion or bumper 44 of resilient elastomer material such as neoprene W.D. rubber is secured by sliding into a dovetail notch in the bottom of the guide 40 in a position to be engaged by the top of the flexible connector 38 in the raised position of the piston 34 shown in FIG. 4. The cylinder 32 extends through an opening in the guide 40 and is attached by a gusset 45 to a metal support bracket 46 which is fastened to the guide 40 by two bolts 48 and nuts 50 as shown in FIG. 3. The cylinder 32 is provided with a lower exhaust port 52 at a central position intermediate the opposite ends of such cylinder to enable the air in such cylinder to be rapidly exhausted once the piston 34 reaches the downwardmost position of the blades shown in phantom lines in FIG. 4. The upper end of the cylinder 32 is secured in any suitable manner such as by welding or soldering to a knife support plate 54 of metal. The cylinder 32 communicates through a passageway 56 inclined at an angle of 27 degrees in the support plate 54 to the solenoid actuated valve 30 mounted on a valve support member 58. The valve support member 58 is secured to the support plate by bolts 60 and is provided with a threaded passageway 62 aligned with the threaded output of the valve 30 and in communication with the passageway 56 of the cylinder 52. Thus, when the solenoid valve is opened and closed in about 3.5 milliseconds by a control signal applied to leads 63, a pulse of air is transmitted from a pressurized air inlet 64 through such valve and into the cylinder 32 by way of passages 62 and 56 to cause the piston 34 to be moved rapidly downward within the cylinder. This moves the knife blade 36 connected to the piston rod 37 from the raised position shown in solid lines to the lower position shown in dashed lines in FIG. 4. The complete cycle of operation of the cutter apparatus takes about 20 milliseconds and will be more completely described with reference to FIGS. 6A to 6F.

The valve 30 may be provided with an adjustable upper exhaust port 66 in order to control the pressure of the air pulse applied to the cylinder 32 which in turn controls the speed of movement of the piston 34. The knife blade 36 and the piston 34 are resiliently urged upward from the lowered position to the raised position by means of a rubber band type of resilient strap member 68 of neoprene W.D. rubber. The opposite ends of the rubber strap 68 are secured in two plastic holder spools 70 of Teflon which are bolted to the opposite sides of the support plate 54 by means of two bolts 72. A small piston rod tip aperture 74 is provided in an enlarged mid-portion of the rubber strap at a midpoint between its opposite ends for engagement by the end 76 of the piston rod which extends through a flexible plastic snap ring 78 of Teflon that prevents wear of the rubber strap by the piston rod or the flexible connector 38. A rubber O-ring 80 may be provided between the knife support plate 54 and the valve support member 60 surrounding the passage 56 in order to provide an airtight seal.

As shown in FIGS. 6A to 6F, the cutter apparatus of the present invention operates in the manner described below. In this regard, the solenoid actuated valves 30 open and close in approximately 3.5 milliseconds and the conveyor belt 14 conveys the french fry potato strip 12 or other elongated food product at a speed of approximately 300 feet per minute in the direction of arrow 82. The operation of one of the cutter assemblies is hereafter described.

Figure 6A:
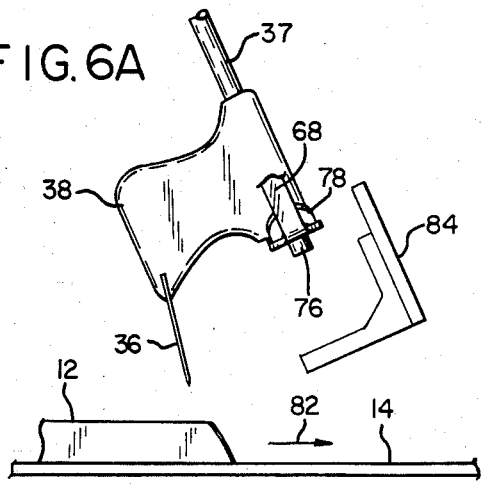
FIGS. 6A to 6F show different steps in the operation of the cutter apparatus of the present invention.
Figure 6B:
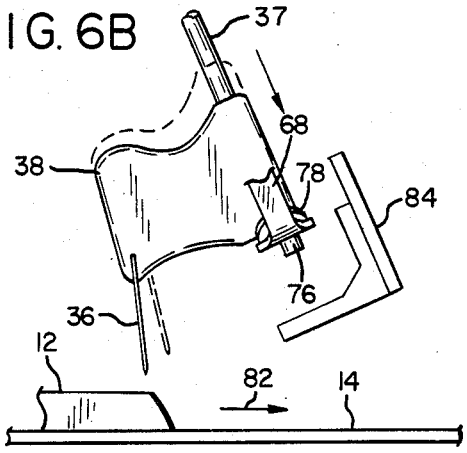
Figure 6C:
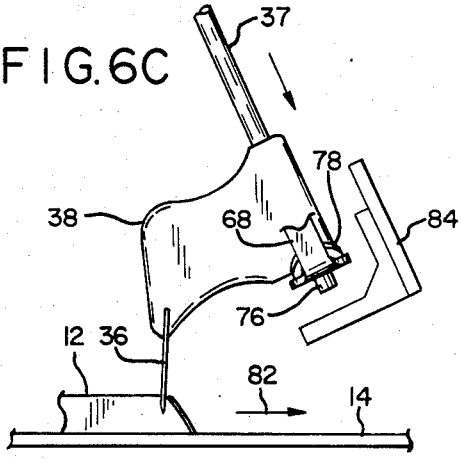
Figure 6D:
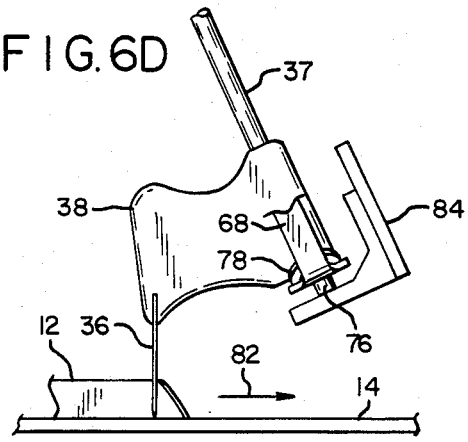
Figure 6E:
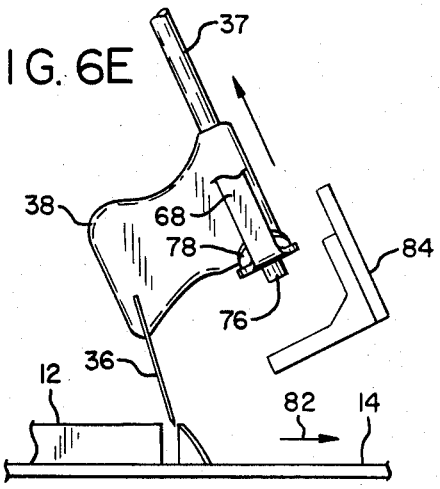
Figure 6F:
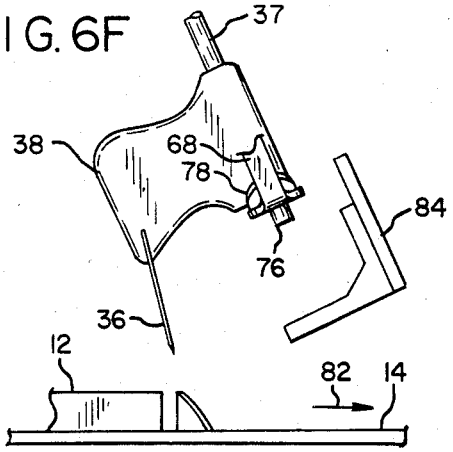

As shown in FIG. 6A, in the static raised position, the knife blade 36, the flexible connector 38 and piston rod 37 are held in such raised position by the rubber band strap 38. In FIG. 6B when an air pulse is applied to the cylinder 32 by the solenoid actuated valve 30, the piston 34 and piston rod 37 begin to move downward causing both downward movement and upward deflection of the flexible connector 38 and the knife blade 36 relative to the piston rod 37 so that such knife blade is moved in a non linear manner in response to linear movement of the piston rod activator member. This is caused by the lagging behind of the knife blade in following movement of tne piston rod due to the fact that such knife blade is attached by a flexible canteliver arm to the piston rod. Thus, the flexible connector of elastomer material tends to deflect upward and "wind up" like a coil spring during downward movement of the piston rod. As shown in FIG. 6C, when the knife blade first strikes the food product the flexible connector 38 begins to unwind and causes the angle of the knife blade to change to a more vertical position. Continued downward movement of the piston rod causes further cutting of the food product 12 until the knife blade 36 strikes the conveyor belt 14 as shown in FIG. 6D. At this point, the flexible connector 38 is still partially wound up. The flexing of the flexible connector 38 during unwinding causes the blade to move from the inclined position shown in FIG. 6C to the substantially vertical position in FIG. 6D at the completion of a cut when the piston rod is in its most downward position. The piston rod may engage an optional secondary stop 84 attached to the valve support member 58, in the downward position of FIG. 6D which limits overtravel of the knife blade so it is not dulled or the conveyor belt cut, and prepares the knife assembly for return movement upward. In FIG. 6E the rubber band strap 68 begins to return the knife blade assembly upward to the static position of FIG. 6A and the knife blade is disengaged from the belt. As a result, the flexible connector unwinds further to its normal relaxed position thereby following the travel of the conveyor belt to prevent movement of the cut food product. Then the knife blade assembly is moved upward into the static position again in FIG. 6F by the rubber band strap 68. This completes one cycle of operation of the cutter apparatus. The cycle of operation shown in FIGS. 6A to 6F is repeated for each of the two knife blade assemblies 26 and 28 in FIG. 4 to make the two cuts necessary at the opposite ends of the defect for removal of a defect in the french fry potato strip or other elongated food product.

It will be obvious to those having ordinary skill in the art that many changes may be made in the above-described preferred embodiment of the invention. Therefore, the scope of the present invention should be determined by the following claims.

We claim:

1. Food defect removal apparatus, comprising:

cutter means for cutting an elongated food product at a predetermined point as it is conveyed along a path of travel to remove a defect therefrom, including at least one knife blade;

actuator means for moving the knife blade toward the food product to cut said food product when an actuator member is moved from a retracted position to an extended position;

return means for moving the knife blade away from the food product and returning the actuator member from the extended position to the retracted position;

resilient connection means for connecting said blade to said actuator member so that said blade moves in response to movement of said actuator member; and control means for operating said actuator means in response to a control signal to cause the cutter means to cut the food product at a proper location to remove the defect.

2. Apparatus in accordance with claim 1 in which the actuator means is a cylinder means and the actuator member is a piston and piston rod.

3. Apparatus in accordance with claim 2 in which the connection means is a connector member made of elastomer material which moves said blade in a non-linear manner in response to linear movement of said activator member.

4. Apparatus in accordance with claim 3 in which the control means is a solenoid actuated valve for supplying pneumatic pulses to said cylinder means.

5. Apparatus in accordance with claim 3 in which the connector member is provided with a central portion of less width than its opposite ends which are attached, respectively, to the piston rod and to the knife blade so that said knife blade pivots on said connector member about said central portion during linear movement of said piston rod.

6. Apparatus in accordance with claim 1 in which the return means is a resilient bias member.

7. Apparatus in accordance with claim 6 in which the bias member is made of elastomer material.

8. Apparatus in accordance with claim 2 in which the return means is a resilient band fixed at its opposite ends and having a mid-portion which moves and which urges the piston rod from the extended position toward the retracted position.

9. Apparatus in accordance with claim 2 which also includes guide means for guiding the movement of the blade to prevent said blade from pivoting about the axis of the piston rod.

10. Apparatus in accordance with claim 9 in which the guide means includes a pair of guide fingers which extend on opposite sides of the connection means so that said connection means slides along between said guide fingers during movement of said piston rod.

11. Apparatus in accordance with claim 1 in which the cutter means includes a second knife blade spaced from the first mentioned blade along the path of the food product, said second blade being associated with second actuator means, second return means, second resilient connection means and second control means so that said first and second blades are independently controlled to cut the food product and thereby remove defects of different length.

12. Apparatus in accordance with claim 11 in which the actuator means are cylinder means, the return means are resilient bands, and the control means are valves.

13. Food cutting apparatus, comprising:

cutter means for cutting an elongated food product as it is conveyed along a path of travel, including at least one knife blade;

cylinder means for moving the knife blade toward the food product to cut said food product when the piston of said cylinder means is moved from a retracted position to an extended position;

resilient bias means for moving the knife blade away from the food product and returning the piston from the extended position to the retracted position;

resilient connection means for connecting the knife blade to the piston so that said blade moves in response to movement of said piston; and valve means for operating said cylinder means to cause the cutter means to cut the food product.

14. Appartus in accordance with claim 13 in which the resilient bias means is a bias member of elastomer material which urges the piston rod from the extended position to the retracted position.

15. Apparatus in accordance with claim 14 in which the bias member is a rubber band fixed at its opposite ends and having a mid-portion which engages a piston rod connected to said piston.

16. Apparatus in accordance with claim 15 which also includes a snap member of flexible plastic fastened to the end of the piston rod and position between the rubber band and the connection means.

17. Apparatus in accordance with claim 13 in which the connection means is a resilient connector member of elastomer material having one end attached to a piston rod fixed to the piston.

18. Apparatus in accordance with claim 17 in which the connector member is provided with a central portion of less width than its opposite ends so that said knife blade pivots on said connector member about said central portion during movement of said piston.

19. Apparatus in accordance with claim 13 in which the piston is of plastic material filled with wear resistant particles.

20. Apparatus in accordance with claim 13 in which the valve means is a solenoid actuated valve.

* * * * *